US012766597B2

(12) United States Patent
Sugawara

(10) Patent No.: US 12,766,597 B2
(45) Date of Patent: Oct. 20, 2026

(54) SILVER POWDER AND METHOD OF PRODUCING SILVER POWDER

(71) Applicant: DOWA Electronics Materials Co., Ltd., Tokyo (JP)

(72) Inventor: Satoko Sugawara, Ageo (JP)

(73) Assignee: DOWA Electronics Materials Co., Ltd., Tokyo (JP)

( * ) Notice: Subject to any disclaimer, the term of this patent is extended or adjusted under 35 U.S.C. 154(b) by 171 days.

(21) Appl. No.: 18/691,043

(22) PCT Filed: Sep. 14, 2022

(86) PCT No.: PCT/JP2022/034483

§ 371 (c)(1),
(2) Date: Mar. 12, 2024

(87) PCT Pub. No.: WO2023/042870

PCT Pub. Date: Mar. 23, 2023

(65) Prior Publication Data

US 2024/0375179 A1 Nov. 14, 2024

(30) Foreign Application Priority Data

Sep. 17, 2021 (JP) ..... 2021-152609
Sep. 13, 2022 (JP) ..... 2022-145586

(51) Int. Cl.
*B22F 9/24* (2006.01)
*B22F 1/05* (2022.01)
*B22F 1/102* (2022.01)

(52) U.S. Cl.
CPC ..... *B22F 9/24* (2013.01); *B22F 1/05* (2022.01); *B22F 1/102* (2022.01); *B22F 2301/255* (2013.01); *B22F 2304/10* (2013.01); *B22F 2998/10* (2013.01); *B22F 2999/00* (2013.01)

(58) Field of Classification Search
CPC ..... C22C 1/0466
See application file for complete search history.

(56) References Cited

U.S. PATENT DOCUMENTS

2005/0167640 A1* 8/2005 Matsushima ..... H01C 17/283 252/512
2009/0236404 A1* 9/2009 Yamakawa ..... H05K 3/321 228/123.1
2017/0216913 A1* 8/2017 Tahara ..... C08K 9/04

FOREIGN PATENT DOCUMENTS

CN 103917316 A 7/2014
CN 107000050 A 8/2017
(Continued)

OTHER PUBLICATIONS

Dec. 6, 2022, International Search Report issued in the International Patent Application No. PCT/JP2022/034483.
(Continued)

*Primary Examiner* — Alexandre F Ferre
(74) *Attorney, Agent, or Firm* — KENJA IP LAW PC

(57) ABSTRACT

Provided are a silver powder that is suitable as a conductive filler for a conductive paste that enables low-temperature firing and a method of producing this silver powder. The method of producing a silver powder includes an azole addition step of adding an azole to a silver ammine complex aqueous solution to obtain a first liquid, a reductant addition step of adding a reductant to the first liquid to obtain a second liquid, and a fatty acid addition step of adding a fatty acid to the second liquid to obtain a third liquid. The fatty acid is an unsaturated fatty acid including two or more double bonds.

6 Claims, 3 Drawing Sheets

(56) References Cited

FOREIGN PATENT DOCUMENTS

| | | | |
|---|---|---|---|
| CN | 113369490 | A | 9/2021 |
| JP | 2005220380 | A | 8/2005 |
| JP | 2011068932 | A | 4/2011 |
| JP | 2015129352 | A | 7/2015 |
| JP | 2016069731 | A | 5/2016 |
| JP | 2017206763 | A | 11/2017 |
| JP | 2020139178 | A | 9/2020 |
| TW | 201812793 | A | 4/2018 |

OTHER PUBLICATIONS

Jan. 30, 2024, Office Action issued by the Taiwan Intellectual Property Office in the corresponding Taiwanese Patent Application No. 111135035.

Nov. 8, 2022, Notification of Reasons for Refusal issued by the Japan Patent Office in the corresponding Japanese Patent Application No. 2022-145586.

Mar. 5, 2024, International Preliminary Report on Patentability issued in the International Patent Application No. PCT/JP2022/034483.

Jun. 27, 2024, Office Action issued by the Taiwan Intellectual Property Office in the corresponding Taiwanese Patent Application No. 111135035.

May 29, 2026, Office Action issued by the China National Intellectual Property Administration in the corresponding Chinese Patent Application No. 202280062174.3.

* cited by examiner

SILVER POWDER AND METHOD OF PRODUCING SILVER POWDER

TECHNICAL FIELD

The present disclosure relates to a silver powder and a method of producing a silver powder.

BACKGROUND

A conductive paste, for example, may be used in order to form a conduction pattern formed on a conductive substrate or an electrode of a substrate, for example. The conduction pattern or the like is formed through application or the like of the conductive paste in a specific pattern or shape, followed by firing of the conductive paste. Such a conductive paste is produced by, for example, using a silver powder as fine conductive particles and dispersing this silver powder with a dispersion medium in the form of a paste (for example, refer to Patent Literature (PTL) 1 and 2).

PTL 1 describes a silver powder having an average particle diameter of not less than 0.1 μm and less than 1 μm and a maximum particle diameter Dmax of 4 μm or less and a method of producing this silver powder without using a polyhydric phenol such as hydroquinone as a reductant. In this method of producing a silver powder, a reductant is added into an aqueous reaction system containing silver ions to cause reduction precipitation of silver particles. Moreover, in this method of producing a silver powder, one or more selected from a fatty acid, a fatty acid salt, and a fatty acid ester are added into the aqueous reaction system prior to reductant addition, and a chelating agent is added into the aqueous reaction system after reductant addition. PTL 1 discloses that it is preferable to use one or more selected from the group consisting of benzotriazole, a sodium salt of benzotriazole, and a potassium salt of benzotriazole as the chelating agent in the method of producing a silver powder because such a chelating agent is easily dispersed in the aqueous reaction system containing silver ions regardless of liquid properties.

PTL 2 describes a method of producing a silver powder by mixing a silver ammine complex aqueous solution and a reductant. In this method of producing a silver powder, a pre-additive including a water-soluble polymer that includes a carboxyl group and has an average molecular weight of 1,000 or more is added to the silver ammine complex aqueous solution prior to mixing of the silver ammine complex aqueous solution and the reductant, and a surface treatment agent selected from a fatty acid, a salt of a fatty acid, an azole, a surfactant, an organometallic compound, and a chelating agent is added to a slurry obtained after mixing of the reductant. PTL 2 also describes mixing of this silver powder with a resin and a solvent to yield a conductive paste. Terpineol, butyl carbitol, butyl carbitol acetate, and texanol are given as examples of the solvent used to obtain the conductive paste.

CITATION LIST

Patent Literature

PTL 1: JP2011-68932A
PTL 2: JP2017-206763 A

SUMMARY

Technical Problem

There has been increasing need for conductive pastes that enable firing at low temperature in order to relieve thermal stress on a substrate and to facilitate wire printing on a resin substrate or the like having low heat resistance, for example. A firing temperature of 200° C. or lower, for example, is desirable. In order to respond to this need, there is demand for a silver powder that is suitable for low-temperature firing and a method of producing this silver powder.

The present disclosure is made in light of the circumstances set forth above, and an object thereof is to provide a silver powder that is suitable as a conductive filler for a conductive paste that enables low-temperature firing and also to provide a method of producing this silver powder.

Solution to Problem

A method of producing a silver powder according to the present disclosure for achieving the object set forth above comprises:

- an azole addition step of adding an azole to a silver ammine complex aqueous solution to obtain a first liquid;
- a reductant addition step of adding a reductant to the first liquid to obtain a second liquid; and
- a fatty acid addition step of adding a fatty acid to the second liquid to obtain a third liquid, wherein
- the fatty acid is an unsaturated fatty acid including two or more double bonds.

In the method of producing a silver powder according to the present disclosure, the unsaturated fatty acid may include linoleic acid or linolenic acid.

A silver powder according to the present disclosure for achieving the object set forth above has:

- a specific surface area based on the BET method of not less than 1.5 $m^2/g$ and not more than 2.0 $m^2/g$; and
- a negative value for a difference determined by subtracting a second particle diameter from a first particle diameter given that the first particle diameter is a volume-based median diameter measured by a laser diffraction/scattering particle diameter distribution measurement instrument with butyl carbitol acetate as a dispersion medium and the second particle diameter is a volume-based median diameter measured by the laser diffraction/scattering particle diameter distribution measurement instrument with isopropyl alcohol as a dispersion medium.

A silver powder according to the present disclosure for achieving the object set forth above has:

- a specific surface area based on the BET method of not less than 2.5 $m^2/g$ and not more than 3.0 $m^2/g$; and
- a value of less than 0.3 μm for a difference determined by subtracting a second particle diameter from a first particle diameter given that the first particle diameter is a volume-based median diameter measured by a laser diffraction/scattering particle diameter distribution measurement instrument with butyl carbitol acetate as a dispersion medium and the second particle diameter is a volume-based median diameter measured by the laser diffraction/scattering particle diameter distribution measurement instrument with isopropyl alcohol as a dispersion medium.

The silver powder according to the present disclosure may comprise an azole and linoleic acid at a particle surface. Moreover, the silver powder according to the present disclosure may comprise an azole and linolenic acid at a particle surface.

Advantageous Effect

It is possible to provide a silver powder that is suitable as a conductive filler for a conductive paste that enables low-temperature firing and a method of producing this silver powder.

DETAILED DESCRIPTION

Figure 1:
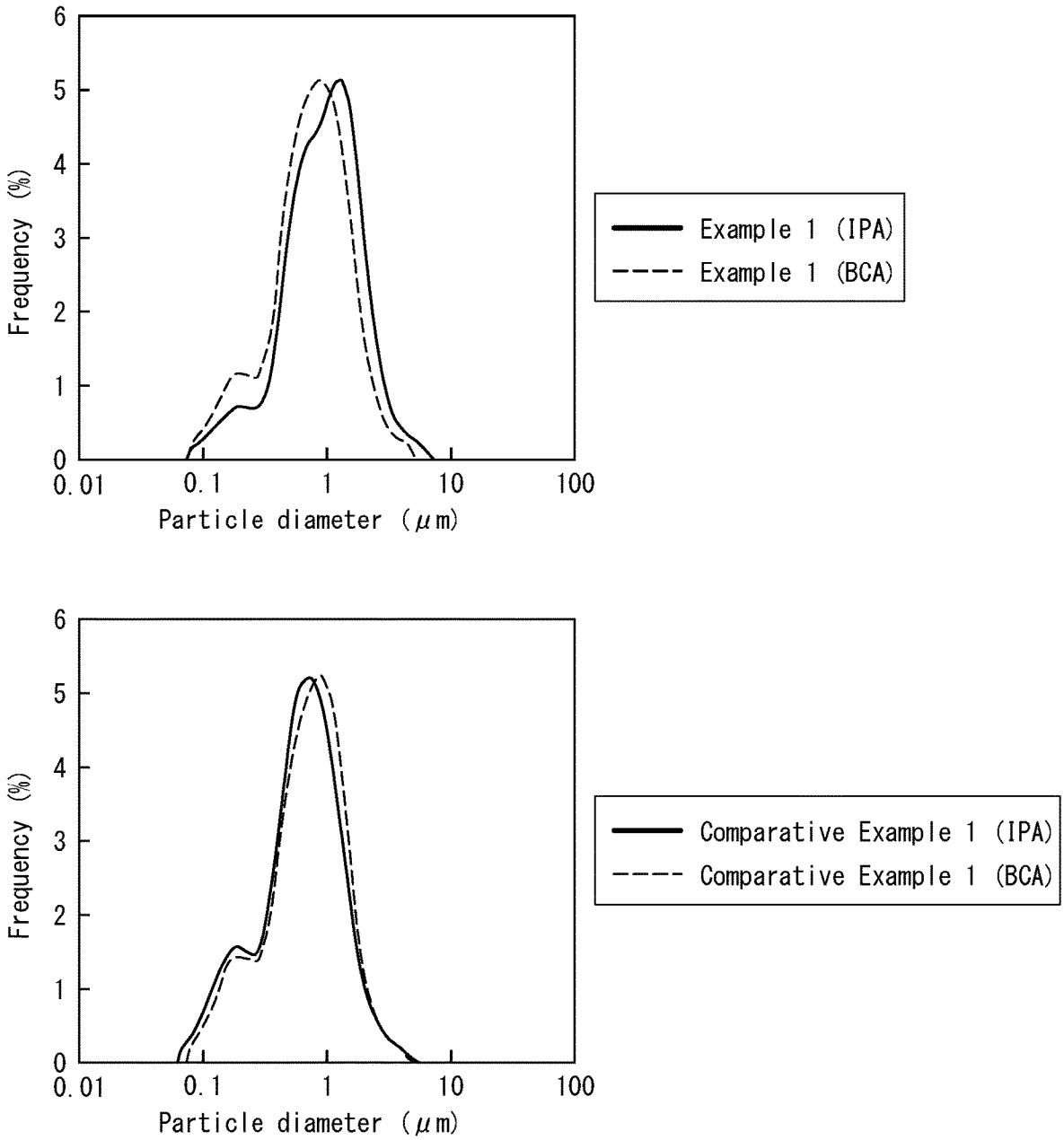
FIG. 1 presents graphs illustrating particle size distributions of silver powders of Example 1 and Comparative Example 1.

The following describes a silver powder and method of producing the same according to a present embodiment with reference to the drawings.

The silver powder and method of producing the same that are described below relate to a silver powder that is suitable for use as a conductive filler for a conductive paste that enables low-temperature firing (i.e., a conductive paste used with a presumption that firing is performed at low temperature) and a method of producing this silver powder.

First, the following outlines the method of producing a silver powder according to the present embodiment. As described in PTL 2, butyl carbitol acetate (hereinafter, also denoted as BCA) is often used as a solvent in conductive pastes. Low-temperature firing is realized by, for example, reducing the particle diameter or improving the dispersibility of fine silver particles in a conductive paste. Accordingly, the method of producing a silver powder according to the present embodiment is a method that focuses on realizing low-temperature firing through the provision of a silver powder having good compatibility with and good dispersibility in BCA, as one example.

The method of producing a silver powder according to the present embodiment includes an azole addition step of adding an azole to a silver ammine complex aqueous solution to obtain a first liquid, a reductant addition step of adding a reductant to the first liquid to obtain a second liquid, and a fatty acid addition step of adding a fatty acid to the second liquid to obtain a third liquid.

The fatty acid that is added in the fatty acid addition step is an unsaturated fatty acid including two or more double bonds.

The unsaturated fatty acid preferably includes linoleic acid or linolenic acid.

Through the method of producing a silver powder according to the present embodiment, it is possible to provide a silver powder that is suitable as a conductive filler for a conductive paste that enables low-temperature firing and a method of producing this silver powder. Moreover, it is possible to provide a silver powder that has good compatibility with butyl carbitol acetate, in particular, that is suitable for use as a conductive filler for a conductive paste, and that has good dispersibility.

The method of producing a silver powder according to the present embodiment is described in detail below.

The silver ammine complex aqueous solution may be a solution that is produced by adding ammonia water or an ammonium salt to a feedstock liquid such as a silver nitrate aqueous solution or a silver oxide suspension. A pH modifier may be added to the feedstock liquid or the silver ammine complex aqueous solution. A typical acid or base may be used as the pH modifier. Examples of the pH modifier include nitric acid and sodium hydroxide.

The azole addition step is a step of adding an azole to the silver ammine complex aqueous solution to obtain a first liquid. Examples of the azole include imidazole, oxazole, thiazole, selenazole, pyrazole, isoxazole, isothiazole, 1H-1,2,3-triazole, 2H-1,2,3-triazole, 1H-1,2,4-triazole, 4H-1,2,4-triazole, 1,2,3-oxadiazole, 1,2,4-oxadiazole, 1,2,5-oxadiazole, 1,3,4-oxadiazole, 1,2,3-thiadiazole, 1,2,4-thiadiazole, 1,2,5-thiadiazole, 1,3,4-thiadiazole, 1H-1,2,3,4-tetrazole, 1,2, 3,4-oxatriazole, 1,2, 3, 4-thiatriazole, 2H-1,2,3,4-tetrazole, 1,2,3,5-oxatriazole, 1,2,3,5-thiatriazole, indazole, benzimidazole, benzotriazole, and salts of any thereof. By using any of these azoles, it is possible to obtain a silver powder that is suitable as a conductive filler for a conductive paste. The following provides, as one example of the method of producing a silver powder according to the present embodiment, an illustrative description of a case in which sodium benzotriazole (hereinafter, also denoted as BTA), which is a salt of an azole, is used.

The additive amount of the azole in the azole addition step is preferably 0.05 wt % to 3.0 wt %, and more preferably 0.1 wt % to 1.0 wt % relative to silver. In a situation in which the azole is added prior to reductant addition, the specific surface area of the silver powder changes depending on the pH of the silver ammine complex aqueous solution to which the azole is added. Therefore, it is possible to control the value of the specific surface area of the silver powder that is obtained by altering the pH using the aforementioned pH modifier. For example, when the amount of nitric acid added as a pH modifier to the silver ammine complex aqueous solution is increased so as to lower the pH of the silver ammine complex aqueous solution, this reduces the solubility of the azole, increases nuclei formation when the reductant is added, and, as a result, increases the specific surface area of the silver powder.

The reductant addition step is a step of adding a reductant to the first liquid to obtain a second liquid. Examples of the reductant include hydrazine, hydrazine compounds, and formalin. By using any of these reductants, it is possible to obtain a silver powder that is suitable as a conductive filler for a conductive paste.

Note that the second liquid is in the form of a slurry containing fine silver particles that have precipitated through reduction. It is preferable that a stirred state is maintained in the reductant addition step so as to prevent sedimentation of fine silver particles. In the reductant addition step, addition of an additive other than a reductant (for example, addition of a surfactant) in order to stabilize the slurry state during the precipitation process is not ruled out.

The azole attaches to the precipitated fine silver particles in the reductant addition step. This is thought to result in the stable dispersion of fine silver particles in the second liquid.

The fatty acid addition step is a step of adding a fatty acid to the second liquid to obtain a third liquid. Note that the fatty acid in the present embodiment is an unsaturated fatty acid including two or more double bonds. The unsaturated fatty acid is preferably a linear fatty acid. It is particularly preferable that the unsaturated fatty acid includes linoleic acid, which is linear and includes two double bonds, or linolenic acid, which is linear and includes three double bonds. The use of such a fatty acid as the fatty acid lowers the viscosity of a conductive paste that is produced using a silver powder obtained by the method of producing a silver powder according to the present embodiment and makes the conductive paste suitable for application or printing for forming a conduction pattern or an electrode of a substrate. Moreover, this conductive paste is suitable for low-temperature firing.

The additive amount of the fatty acid in the fatty acid addition step is preferably 0.05 wt % to 3.0 wt %, and more preferably 0.1 wt % to 1.0 wt % relative to silver.

The unsaturated fatty acid that is added in the fatty acid addition step adsorbs to the surfaces of the fine silver particles. Note that in the fatty acid addition step, the addition of an additive other than the unsaturated fatty acid (for example, addition of a surfactant) in order to stabilize the slurry state during the process until adsorption of the unsaturated fatty acid to the surfaces of the fine silver particles is complete is not ruled out.

In the fatty acid addition step, the unsaturated fatty acid adsorbs uniformly to the surfaces of the fine silver particles that are in a dispersed state as a result of stable dispersion of the fine silver particles continuing on from the reductant addition step. This yields a silver powder that makes it possible to realize high dispersion and low viscosity when used to form a conductive paste.

Once the fatty acid addition step is complete, a washing and recovery step of recovering a cake of silver powder from the third liquid is performed. In the washing and recovery step, the slurry is dehydrated and a cake of silver powder is washed. The washing in the washing and recovery step may be performed using pure water, for example. The dehydration in the washing and recovery step can be performed by decantation or filter pressing, for example. A completion point of the washing may be judged using the electrical conductivity of washing water. Specifically, the washing may be judged to be complete once the electrical conductivity of washing water is not more than a specific value.

After completion of the washing and recovery step, a drying step of drying the recovered silver powder cake is performed. The drying step may be performed by vacuum drying or by using an airflow-type dryer. In the drying step, high-pressure airflow may be blown against the cake or the silver powder in the drying process, or the cake or the silver powder in the drying process may be loaded into a stirring machine having a stirring rotor or a milling machine having a milling rotor and may be stirred so as to perform an operation of imparting dispersing force to the cake or the silver powder in the drying process and promoting dispersion and drying.

Note that the temperature of the silver powder in the drying step should be set as 100° C. or lower. In a situation in which the temperature of the silver powder exceeds 100° C., sintering of fine silver particles in the silver powder may occur.

A disintegration, milling, or classification operation for adjusting a particle size distribution of the silver powder may be performed concurrently to the drying step or after the drying step. The milling operation may be performed using an airflow-type or mechanical-type milling machine. The classification operation may be performed by a classifying rotor or through airflow classification using swirling airflow, or may be performed by inertial force classification or a sieving operation.

A silver powder that is produced by the method of producing a silver powder in the present embodiment is subjected to measurement of at least specific surface area (hereinafter, also denoted as SSA) and a particle size distribution in a wet state. The ignition loss (hereinafter, also denoted as Ig-loss) is measured and the amount of organic material in the silver powder is evaluated as necessary. Moreover, the residual amount of the azole in the silver powder (i.e., the amount of the azole that is attached to the fine silver particles) is measured as necessary.

The specific surface area of the silver powder may be taken to be the specific surface area measured by the BET method. Measurement of the specific surface area according to the BET method may be performed using a specific surface area measurement instrument that implements such measurement. In the present embodiment, a case in which a value measured using a Macsorb HM-model 1210 produced by Mountech Co., Ltd. as a measurement instrument for specific surface area according to the BET method is adopted is described below as an example. In measurement of the specific surface area in the present embodiment, He-$N_2$ mixed gas (30% nitrogen) is passed inside the measurement instrument for 10 minutes at 60° C. to perform deaeration, and then a value measured by the single-point BET method is adopted.

For the particle size distribution of the silver powder, values measured using a laser diffraction/scattering particle diameter distribution measurement instrument (laser diffraction particle size distribution instrument) with the silver powder dispersed in a specific dispersion medium (i.e., in a wet state) may be adopted. In the present embodiment, a case in which a Microtrac particle size distribution measurement instrument MT-3300EXII (hereinafter, also referred to simply as a particle size distribution measurement instrument) produced by MicrotracBEL Corp. is used as a laser diffraction/scattering particle diameter distribution measurement instrument is described below as an example.

In the present embodiment, values measured on a volume basis are adopted for a particle size distribution of the silver powder. The median diameter (particle diameter corresponding to a cumulative value of 50%, also referred to as $D_{50}$) is taken to be a volume-based value.

Measurement of a particle size distribution in the present embodiment is performed for two cases: a case in which isopropyl alcohol (IPA) is adopted as a solvent used in dispersion (hereinafter, referred to simply as a dispersion medium); and a case in which butyl carbitol acetate (CAS No. 124-17-4) is adopted as a dispersion medium.

In measurement of the particle size distribution, first the silver powder is caused to disintegrate. Disintegration of the silver powder is performed using a Sample Mill SK-M10 produced by Kyoritsu Riko. Next, 0.1 g of the silver powder that has undergone disintegration is measured out, and the measured out silver powder is dispersed in 40 mL of the dispersion medium. Dispersing is performed through 2 minutes of stirring by an ultrasonic homogenizer (model: US-150T) produced by NIHONSEIKI KAISHA LTD. The dispersion of the silver powder is subsequently loaded into the particle size distribution measurement instrument, and a particle size distribution is measured. As previously described, measurement of a particle size distribution is performed for a case in which the dispersion medium is isopropyl alcohol and a case in which the dispersion medium is butyl carbitol acetate.

Measurement of ignition loss of the silver powder is performed based on the reduction of mass of a sample of the silver powder after heating of the sample. In the present embodiment, a silver powder sample is first precisely weighed (weighed value: w1), is loaded into a magnetic crucible, and is heated to 800° C. Heating at 800° C. is performed for 30 minutes so as to allow sufficient time until a constant quantity is reached. Thereafter, the silver powder sample is cooled and is reweighed (weighed value: w2). The ignition loss is determined by substituting the weighed values w1 and w2 into the following formula (formula 1). In the present embodiment, a case in which the weighed value w1 is 2 g is described below as an example.

$$\text{Ignition loss (mass \%)}=(w1-w2)/w1\times100 \quad (1)$$

The residual amount of the azole (BTA in the present embodiment) in the silver powder (i.e., the amount of the azole that is attached to the surfaces of the fine silver particles) may be determined by performing quantitative analysis by light absorbance photometry with respect to a washing liquid obtained by washing the silver powder with hydrochloric acid aqueous solution. In the present embodiment, a value that is determined by weighing out 0.2 g of the silver powder and then performing washing thereof with hydrochloric acid aqueous solution and quantitative analysis thereof by light absorbance photometry according to the following procedure is adopted. First, concentrated hydrochloric acid (produced by Kanto Chemical Co., Inc.; special grade) is diluted with pure water to prepare 18 mass % hydrochloric acid aqueous solution. Next, 0.2 g of the silver powder and 20 mL of the hydrochloric acid aqueous solution are loaded into a 100 ml beaker made of glass and are heated to cause boiling. Once boiling begins, heating is continued for 15 minutes so as to maintain a boiling state. In order that evaporation to dryness of the solution does not occur during heating, 18 mass % hydrochloric acid aqueous solution is further added in an amount such that the volume of liquid does not exceed that prior to heating. Once the heating is complete, the solution is cooled to 25° C. and is subsequently filtered. The filtrate is made up to a volume of 20 mL through addition of 18 mass % hydrochloric acid aqueous solution to prepare a measurement sample solution for light absorbance photometry.

The light absorbance of the measurement sample solution is measured by a spectrophotometer (U-3210 produced by Hitachi, Ltd.) so as to measure the light absorbance of a peak having a peak wavelength of 272.8 nm±0.5 nm.

A calibration curve for a relationship between azole concentration and light absorbance is determined in advance. The concentration of the azole in the filtrate is determined from this calibration curve and the value for light absorbance of the measurement sample solution, and then the amount (mass %) of the azole that is attached to the surface of the silver powder is determined based on this concentration, the volume of the filtrate, and the weighed value of the silver powder.

Qualitative analysis for confirming the type of fatty acid that is attached to the silver powder can be performed by heating the silver powder to cause detachment of organic material from the surface of the silver powder by evaporation or the like, and then performing qualitative analysis of gas containing the detached organic material using a gas chromatograph mass spectrometer (also referred to as a GC-MS). The amount of the fatty acid that is attached to the silver powder may be regarded as an amount determined by subtracting the residual amount of the azole (BTA in the present embodiment) in the silver powder from the ignition loss described above. Alternatively, the residual amount of organic material (particularly the fatty acid in the present embodiment) in the silver powder (i.e., the amount of organic material attached to the surfaces of the fine silver particles) may be determined by heating the silver powder to cause detachment of organic material from the surface of the silver powder by evaporation or the like and then performing quantitative analysis of gas containing the detached organic material using a gas chromatograph mass spectrometer (also referred to as a GC-MS). The attached amount of the fatty acid should be within a range of 0.1 wt % to 1.0 wt % relative to silver. In the present embodiment, qualitative analysis of organic material in the silver powder (at the surfaces of fine silver particles) and analysis of the attached amount thereof can be performed by using a pyrolyzer (EGA/Py-3030D produced by Frontier Laboratories Ltd.) to heat the silver powder to 300° C., and then using a GC-MS (7890A/5975C produced by Agilent Technologies Japan, LTD.) to determine a value for organic material that has detached from the surfaces of the fine silver particles.

The silver powder in the present embodiment is suitable for use as a conductive filler for a conductive paste. Production of a conductive paste in which the silver powder in the present embodiment is used is performed by dispersing the silver powder in a resin serving as a base material and a solvent.

Examples of the resin that is used in the dispersing include epoxy resin, acrylic resin, polyester resin, polyimide resin, polyurethane resin, phenoxy resin, silicone resin, and ethyl cellulose. Two or more types of resins may be used together.

Examples of the solvent used in the dispersing (i.e., the dispersion medium) include terpineol, butyl carbitol, butyl carbitol acetate, and texanol.

Two or more types of solvents may be used together. Note that the silver powder in the present embodiment is, in particular, suitable for dispersion in a dispersion medium including butyl carbitol acetate.

Production of the conductive paste (i.e., dispersing or kneading) may be performed by ultrasonic dispersing, a disper blade, a three-roll mill, a ball mill, a bead mill, a twin-screw kneader, a planetary stirring device, or the like. A conductive paste in which the silver powder of the present embodiment is used is suitable for forming an electrode or for forming a conduction pattern on a substrate. A conductive paste in which the silver powder of the present embodiment is used can be used to form a conduction pattern or electrode (hereinafter, also referred to inclusively as a "conduction pattern or the like") through printing on a substrate by screen printing, offset printing, photolithography, or the like.

As previously described, there has been demand for conductive pastes that are suitable for low-temperature firing in recent years. Low-temperature firing is realized by reducing the particle diameter or improving the dispersibility of fine silver particles in a conductive paste. Improvement of dispersibility of fine silver particles is realized by, for example, reducing the particle diameter of the fine silver particles and controlling surface physical properties of the fine silver particles. Control of surface physical properties of the fine silver particles can be performed by adjusting the types and amounts of additives that are attached to the surfaces of the fine silver particles, controlling the state of attachment, and so forth. This adjustment or control can be performed by adjusting or controlling the order of addition and additive amounts of various additives (azole, reductant, and fatty acid in the present embodiment), the concentration, and the temperature in a precipitation process of the fine silver particles.

Reduction of the particle diameter of the fine silver particles may lead to an increase of viscosity of the conductive paste. However, there is demand for lower conductive paste viscosity from a viewpoint of coatability in order to support electronic component miniaturization, densification of a conduction pattern or the like, fine line formation, etc. The viscosity of the conductive paste is measured using a rotational viscometer, for example.

Low specific resistance (volume resistivity) is demanded as a prerequisite for a conductive paste after firing (i.e., a conduction pattern or the like). In other words, enabling low-temperature firing means enabling appropriate formation of a conduction pattern or the like by low-temperature firing while also enabling suitably low specific resistance of the conduction pattern or the like. It is thought that a conductive paste having low resistance can be realized when a silver powder having high dispersibility is used as a conductive filler in the conductive paste. This is because when such a silver powder is used, fine silver particles become densely arranged during application or the like, there is a low tendency for voids to form between the particles, and it is possible to form a dense conduction pattern even after sintering. Note that measurement of viscosity of a conductive paste and measurement of specific resistance can be performed as follows.

The viscosity of the conductive paste can be taken to be a value measured using a rotational viscometer. In the present embodiment, the viscosity is measured under the following conditions using a DV-III produced by Brookfield as a viscometer. Measurement of viscosity using a DV-III produced by Brookfield in the present embodiment is performed using a CP-52 cone as a rotor. The measurement temperature is set as 25° C. and the rotor speed is set as 1 rpm. The value of the viscosity is taken to be a value at a point after 5 minutes of rotation of the rotor.

The specific resistance may be taken to be a value that is determined by forming a film of a conductive paste with a specific shape, firing this film to obtain a conductive film as a conduction pattern, and determining the specific resistance based on a resistance value of this conductive film. In the present embodiment, the specific resistance is taken to be a value measured by the following procedure. First, an evaluation subject silver powder is used to produce a conductive paste. This conductive paste is used to print a line pattern of 500 μm in width and 37.5 mm in length on an alumina substrate using a screen printer (MT-320T produced by Micro-tec Co., Ltd.) with a squeegee pressure of 0.18 MPa so as to form a film of the conductive paste. This film is thermally cured (fired) at 200° C. for 10 minutes or at 120° C. for 30 minutes using an air circulation-type dryer to form a conductive film. A surface roughness meter (SURFCOM 480B-12 produced by Tokyo Seimitsu Co., Ltd.) is used to measure a step between a section where the conductive film is not printed on the alumina substrate and a section where the conductive film is present and to thereby measure the average thickness of the conductive film. In addition, a digital multimeter (7451A produced by ADC Corporation) is used to measure a resistance value of the conductive film. The volume of the conductive film is determined from the size (film thickness, width, and length) of the conductive film, and the specific resistance is then determined from this volume and the measured resistance value. In the present embodiment, the specific resistance is determined using the following formula 2.

$$\text{Specific resistance } ((\Omega\cdot\text{cm}) = \text{Resistance value } (\Omega) \times \text{Film thickness (cm)} \times \text{Width (cm)}/\text{Length (cm)} \quad (2)$$

The following describes examples of the silver powder in the present embodiment.

Example 1

First, 3.3 g of 60 mass % nitric acid aqueous solution was added to 3,375 g of silver nitrate aqueous solution containing 45.3 g of silver, and then 76.5 g of industrial use ammonia water of 28 mass % in concentration (corresponding to 1.5 molar equivalents of ammonia relative to 1 mol of silver) was further added to yield a silver ammine complex aqueous solution.

Next, the liquid temperature of the silver ammine complex aqueous solution was adjusted to 35° C. Thereafter, 20.57 g of 1.1 mass % sodium benzotriazole aqueous solution was added (0.5 mass % of sodium benzotriazole added relative to silver) as an azole under stirring to obtain a first liquid. An aqueous solution obtained by diluting 12.5 g of hydrous hydrazine of 80 mass % in concentration with 130.2 g of pure water was subsequently added as a reductant to the first liquid to obtain a slurry containing fine silver particles as a second liquid.

In addition, linoleic acid (produced by FUJIFILM Wako Pure Chemical Corporation; purity: 88 mass %) was added to the second liquid as an external proportion of 0.6 weight % relative to the amount of Ag and was stirred therewith to obtain a third liquid. Note that the linoleic acid was added as a solution obtained by weighing out a specific amount of the linoleic acid of 88 mass % in purity and performing 10-fold dilution thereof with ethanol.

Thereafter, stirring of the third liquid was stopped to cause sedimentation of the fine silver particles, and the third liquid in which the fine silver particles had sedimented was subjected to filtration and washing through passing of water. The washing through passing of water was performed until the electrical conductivity of the washing liquid was 0.5 mS/m or less. The cake present after filtration was subjected to vacuum drying at 73° C. and was then subjected to disintegration using a Sample Mill SK-M10 produced by Kyoritsu Riko. This yielded a silver powder in a dry state.

Example 2

In Example 2, a silver powder was obtained in the same way as in Example 1 with the exception that the additive amount of the 60 mass % nitric acid aqueous solution that was added when obtaining the silver ammine complex aqueous solution was changed to 17.6 g and that 20.57 g of 0.55 mass % sodium benzotriazole aqueous solution was added (0.25 mass % of sodium benzotriazole added relative to silver) as an azole to the silver ammine complex aqueous solution.

Example 3

In Example 3, a silver powder was obtained in the same way as in Example 1 with the exception that the 60 mass % nitric acid aqueous solution used when obtaining the silver ammine complex aqueous solution was not added and that linoleic acid used in Example 1 was changed to linolenic acid (produced by FUJIFILM Wako Pure Chemical Corporation; purity: 60 mass %). Note that the linolenic acid was added as a solution obtained by weighing out a specific amount of the linolenic acid of 60 mass % in purity and performing 10-fold dilution thereof with ethanol.

Example 4

In Example 4, a silver powder was obtained in the same way as in Example 3 with the exception that the additive amount of the 60 mass % nitric acid aqueous solution used when obtaining the silver ammine complex aqueous solution was changed to 23.5 g.

Comparative Example 1

In Comparative Example 1, a silver powder was obtained in the same way as in Example 1 with the exception that linoleic acid used in Example 1 was changed to a stearic acid emulsion (purity: 12 mass %). Note that the stearic acid emulsion was added as a solution obtained by performing 10-fold dilution of the stearic acid emulsion with water such that the amount of stearic acid was 0.6 weight % relative to silver.

Comparative Example 2

In Comparative Example 2, a silver powder was obtained in the same way as in Comparative Example 1 with the exception that the additive amount of the 60 mass % nitric acid aqueous solution added when obtaining the silver ammine complex aqueous solution was changed to 23.5 g.

The SSA, Ig-loss, residual amount of BTA, and particle size distribution were measured for the silver powders of Examples 1 to 4 and Comparative Examples 1 and 2. The results of these measurements are shown in Table 1. Note that in Table 1, D50BCA is the median diameter in a case in which butyl carbitol acetate was used as a dispersion medium in particle size distribution measurement (one example of a first particle diameter). Moreover, D50IPA is the median diameter in a case in which isopropyl alcohol was used as a dispersion medium in particle size distribution measurement (one example of a second particle diameter). Furthermore, BCA–IPA is the value of a difference determined by subtracting D50IPA from the value of D50BCA. FIGS. 1 to 4 present graphs of particle size distributions for the silver powders of Examples 1 to 4 and Comparative Examples 1 and 2. Note that in FIGS. 1 to 4, a notation such as "Example 1 (IPA)" indicates a particle size distribution for a case in which isopropyl alcohol was used as a dispersion medium in particle size distribution measurement, whereas a notation such as "Example 1 (BCA)" indicates a particle size distribution for a case in which butyl carbitol acetate was used as a dispersion medium in particle size distribution measurement.

TABLE 1

| | Powder characteristics | | | Particle size distribution | | |
|---|---|---|---|---|---|---|
| | SSA $m^2/g$ | Ig-loss Mass % | BTA Mass % | D50BCA μm | D50IPA μm | BCA – IPA μm |
| Example 1 | 1.73 | 0.58 | 0.03 | 0.724 | 0.916 | −0.19 |
| Example 3 | 1.81 | 0.53 | 0.07 | 0.949 | 0.959 | −0.01 |
| Comparative Example 1 | 1.78 | 0.69 | 0.04 | 0.677 | 0.622 | 0.06 |
| Example 2 | 2.68 | 0.70 | 0.09 | 0.770 | 0.509 | 0.26 |
| Example 4 | 2.74 | 0.77 | 0.09 | 0.681 | 0.461 | 0.22 |
| Comparative Example 2 | 2.62 | 0.75 | 0.04 | 0.961 | 0.333 | 0.63 |

The silver powders of Examples 1 to 4 and Comparative Examples 1 and 2 were also each used to produce a conductive paste under the subsequently described paste conditions 1, and the viscosity of this paste was measured.

Moreover, the silver powders of Examples 1 to 4 and Comparative Examples 1 and 2 were also each used to produce a conductive paste under the subsequently described paste conditions 2, and the specific resistance was measured.

(Paste Conditions 1)

First, a mixed silver powder is obtained by mixing the evaluation subject silver powder and silver flake powder (FA-S-20 produced by DOWA HIGHTECH CO., LTD.) used as a filler together with the evaluation subject silver powder in a weight ratio of 3:7. Next, 91.04 parts by weight of the mixed silver powder, 3.83 parts by mass of a first epoxy resin (EP4901E produced by Adeka Corporation), 0.96 parts by mass of a second epoxy resin (JER1009 produced by Mitsubishi Chemical Corporation), 0.24 parts by mass of a curing agent (boron trifluoride monoethylamine complex produced by Wako Pure Chemical Industries, Ltd.), and 3.93 parts by mass of a solvent (BCA: butyl carbitol acetate) are set aside. These materials are loaded into a propeller-less planetary stirring and defoaming device (VMX-N360 produced by EME, Inc.) and are stirred and mixed at 1,200 rpm for 30 seconds. The mixture is subsequently passed through and kneaded by a three-roll mill (80S produced by EXAKT Technologies, Inc.) from a roll gap of 100 μm to a roll gap of 20 μm to obtain a conductive paste.

(Paste Conditions 2)

First, a mixed silver powder is obtained by mixing the evaluation subject silver powder and silver flake powder used as a filler together with the evaluation subject silver powder in a weight ratio of 4:6. Next, 92.60 parts by weight of the mixed silver powder, 3.90 parts by weight of a first epoxy resin (EP4901E produced by Adeka Corporation), 0.98 parts by weight of a second epoxy resin (JER1009 produced by Mitsubishi Chemical Corporation), 0.24 parts by mass of a curing agent (boron trifluoride monoethylamine complex produced by Wako Pure Chemical Industries, Ltd.), and 2.28 parts by weight of a solvent (BCA: butyl carbitol acetate) are set aside. These materials are loaded into a propeller-less planetary stirring and defoaming device (VMX-N360 produced by EME, Inc.) and are stirred and mixed at 1,200 rpm for 30 seconds. The mixture is subsequently passed through and kneaded by a three-roll mill (80S produced by EXAKT Technologies, Inc.) from a roll gap of 100 μm to a roll gap of 20 μm to obtain a pre-viscosity adjustment conductive paste. Next, BCA is added to the pre-viscosity adjustment conductive paste in an amount necessary to obtain a post-viscosity adjustment conductive paste having a viscosity adjusted to 300 Pa·s. Viscosity adjustment of the conductive paste is performed by adding small amounts of BCA to the pre-viscosity adjustment conductive paste while repeatedly measuring the viscosity.

A measured value for the viscosity of the conductive paste produced under the paste conditions 1 and a value for the specific resistance of a conductive film formed using the conductive paste produced under the paste conditions 2 are shown in Table 2. A value for the specific resistance is shown for both a case in which thermal curing (i.e., firing) is performed under conditions of 10 minutes at 200° C. and a case in which thermal curing is performed under conditions of 30 minutes at 120° C.

TABLE 2

| | Viscosity | Specific resistance | |
|---|---|---|---|
| | 1 rpm Pa · s | 200° C., 10 min μΩ · cm | 120° C., 30 min μΩ · cm |
| Example 1 | 344 | 92.4 | 225.3 |
| Example 3 | 250 | 47.9 | 229.4 |
| Comparative Example 1 | 410 | 98.8 | 645.1 |

TABLE 2-continued

| | Viscosity | Specific resistance | |
|---|---|---|---|
| | 1 rpm Pa · s | 200° C., 10 min μΩ · cm | 120° C., 30 min μΩ · cm |
| Example 2 | 365 | 71.8 | 127.7 |
| Example 4 | 325 | 69.2 | 219.4 |
| Comparative Example 2 | 472 | 74.5 | 233.5 |

As shown in Table 2, the specific resistance of the conductive films according to Examples 1 and 3 is significantly lower than the specific resistance of the conductive film according to Comparative Example 1, and the specific resistance of the conductive films according to Examples 2 and 4 is significantly lower than the specific resistance of the conductive film according to Comparative Example 2. In particular, in a case in which low-temperature firing conditions (30 minutes at 120° C.) are adopted, the specific resistance of the conductive films according to Examples 1 to 4 is an extremely low value compared to that in Comparative Example 1. It can be seen from these results that the silver powders according to Examples 1 to 4 are each a silver powder that is suitable as a conductive filler for a conductive paste that enables low-temperature firing.

The viscosity of the conductive pastes of Examples 1 and 3 is lower than the viscosity of the conductive paste of Comparative Example 1. Since the viscosity is influenced by the magnitude of the specific surface area, it is necessary to compare cases in which the specific surface area is of roughly the same value. The viscosity of the conductive pastes of Examples 2 and 4 is lower than the viscosity of the conductive paste of Comparative Example 2. It can be judged from these results that the conductive pastes of Examples 1 to 4 have excellent coatability during formation of a conductive film such as an electrode. Specifically, there is thought to be low tendency for nozzle clogging to occur when the paste is discharged from a nozzle of a coating device and low tendency for disconnection to occur even with thinning of a conductive film pattern (electrode pattern).

The reason that compared to the silver powders of the comparative examples, the silver powders of the examples are each suitable as a conductive filler for a conductive paste enabling low-temperature firing in this manner is thought to be that the silver powders according to the examples have good compatibility with BCA and good dispersibility.

Figure 3:
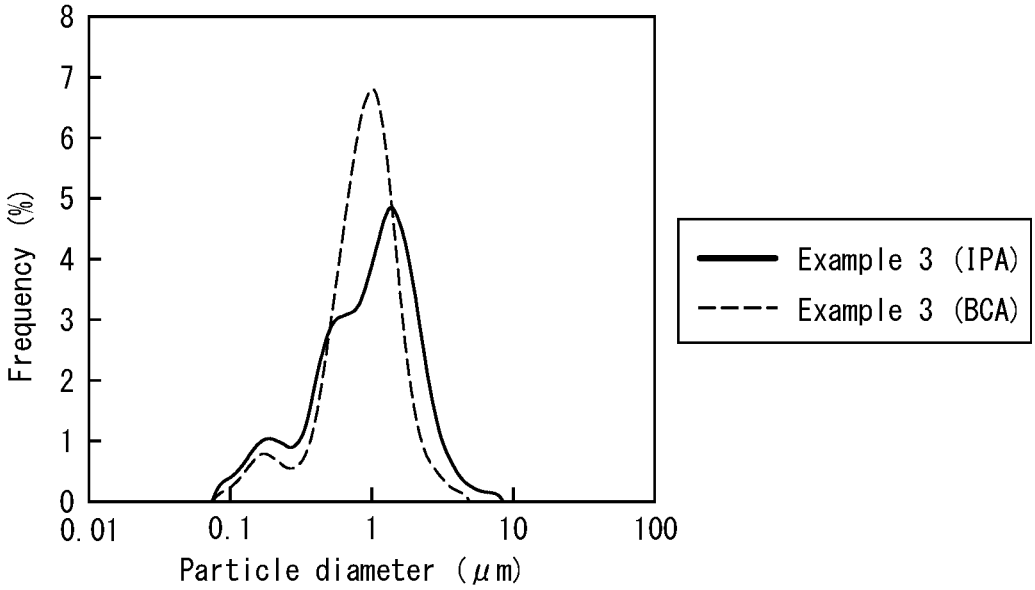
FIG. 3 presents a graph illustrating a particle size distribution of a silver powder of Example 3.

Table 1 and FIGS. 1 and 3 indicate that with regards to cases in which the SSA is not less than 1.5 $m^2/g$ and not more than 2.0 $m^2/g$ (Examples 1 and 3 and Comparative Example 1), Comparative Example 1 does not have a significant difference between D50BCA and D50IPA and has a positive value for BCA-IPA. In contrast, Examples 1 and 3 have a significantly smaller value for D50BCA compared to D50IPA and have a negative value for BCA–IPA. This is thought to indicate that, in other words, the silver powders of Examples 1 and 3 are silver powders having good compatibility with BCA and good dispersibility in BCA.

Figure 2:
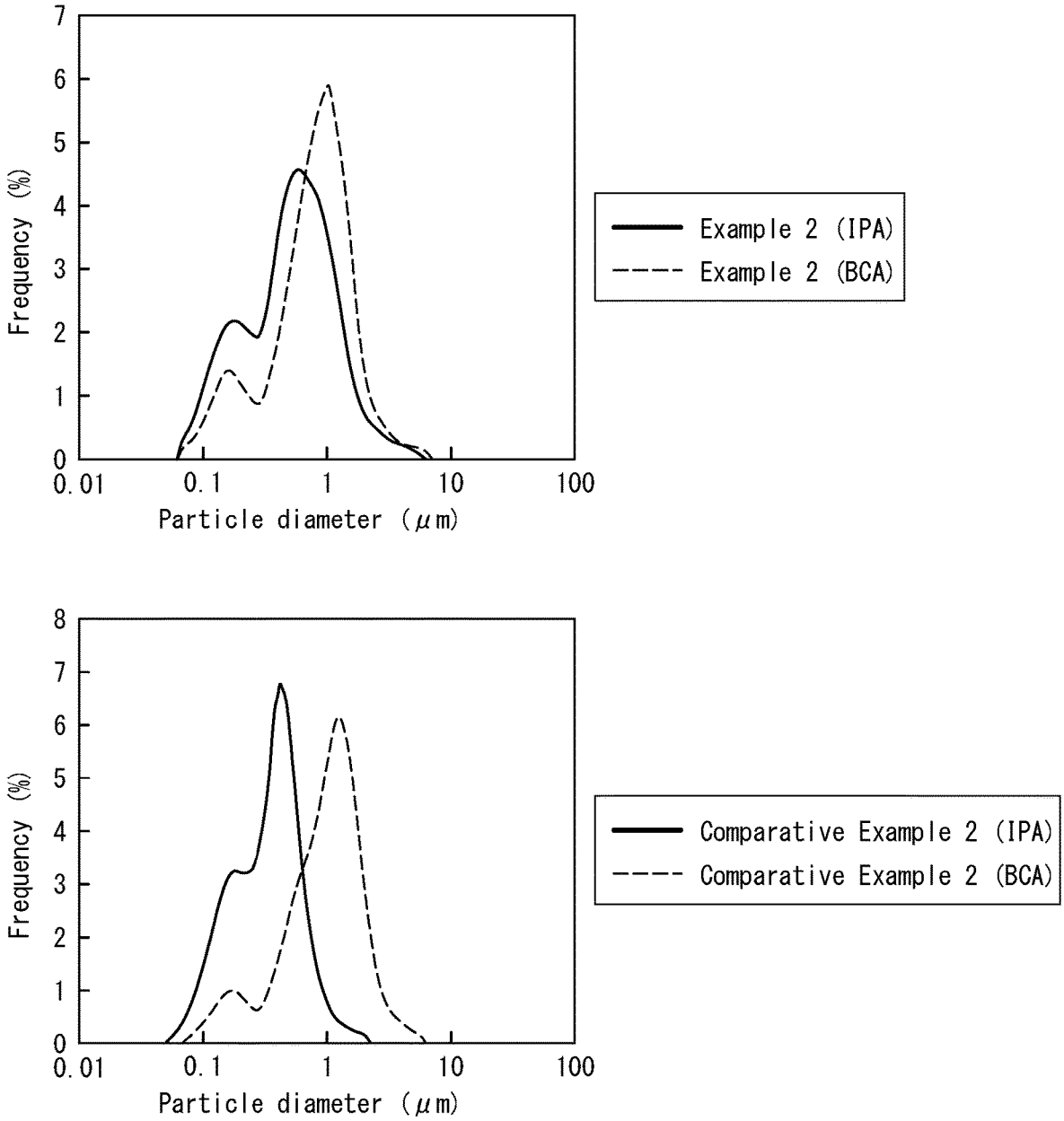
FIG. 2 presents graphs illustrating particle size distributions of silver powders of Example 2 and Comparative Example 2.
Figure 4:
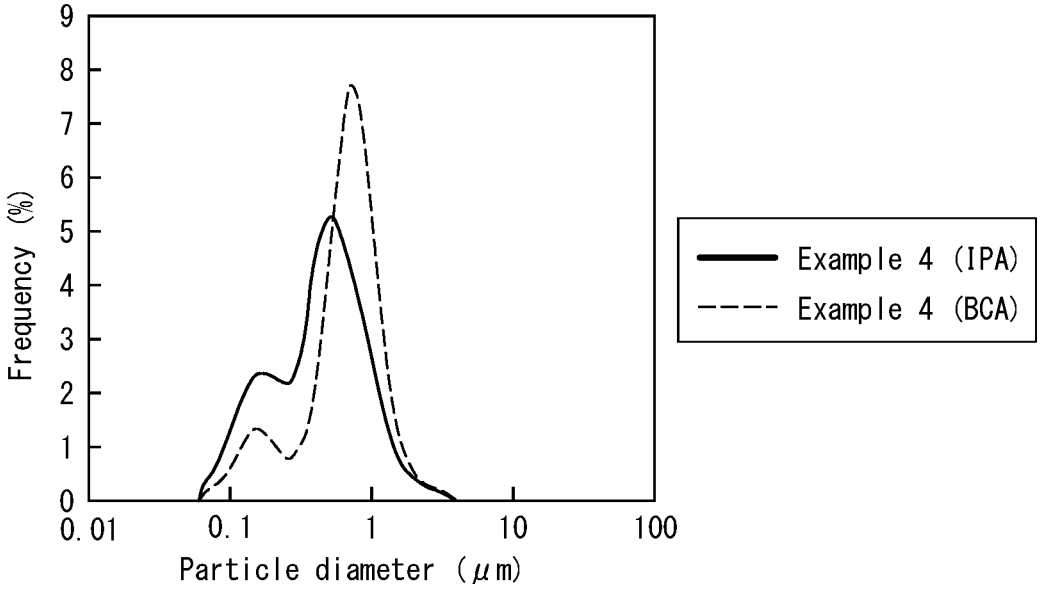
FIG. 4 presents a graph illustrating a particle size distribution of a silver powder of Example 4.

Moreover, Table 1 and FIGS. 2 and 4 indicate that with regards to cases in which the SSA is not less than 2.5 $m^2/g$ and not more than 3.0 $m^2/g$ (Examples 2 and 4 and Comparative Example 2), Comparative Example 2 has a sufficiently low value for D50IPA but conversely has a large value for D50BCA, and thus BCA-IPA is more than 0.3 μm. In contrast, Examples 2 and 4 each have a slightly larger value for D50BCA than for D50IPA, but BCA–IPA is less than 0.3 μm. This is thought to indicate that, in other words, the silver powders of Examples 2 and 4 are silver powders having good compatibility with BCA and good dispersibility in BCA.

As set forth above, a silver powder according to the present embodiment (silver powders of Examples 1 to 4) has better compatibility with BCA and high dispersibility regardless of the magnitude of the SSA.

The results presented above demonstrate that a silver powder produced by the method of producing a silver powder according to the present embodiment is a silver powder that is suitable as a conductive filler for a conductive paste that enables low-temperature firing.

The results presented above are also thought to demonstrate that a silver powder produced by the method of producing a silver powder according to the present embodiment has good compatibility with BCA, in particular, and is particularly suitable for use as a conductive filler for a conductive paste in which BCA is used as a solvent. For example, it is thought that using a silver powder produced by the method of producing a silver powder according to the present embodiment as a conductive filler also yields benefits in terms of enabling lower conductive paste viscosity, particularly in a case in which BCA is adopted as a solvent of the conductive paste, and allowing a higher degree of freedom in selection of a resin serving as a base material of the conductive paste and of additives.

The results presented above also demonstrate that in the case of a silver powder having a specific surface area based on the BET method of not less than 1.5 $m^2/g$ and not more than 2.0 $m^2/g$ and having a negative value for a difference determined by subtracting a second particle diameter from a first particle diameter given that the first particle diameter is a volume-based median diameter measured by a laser diffraction/scattering particle diameter distribution measurement instrument with butyl carbitol acetate as a dispersion medium and the second particle diameter is a volume-based median diameter measured by the laser diffraction/scattering particle diameter distribution measurement instrument with isopropyl alcohol as a dispersion medium, this silver powder is suitable as a conductive filler for a conductive paste enabling low-temperature firing.

Likewise, the results presented above also demonstrate that in the case of a silver powder having a specific surface area based on the BET method of not less than 2.5 $m^2/g$ and not more than 3.0 $m^2/g$ and having a value of less than 0.3 μm for a difference determined by subtracting a second particle diameter from a first particle diameter given that the first particle diameter is a volume-based median diameter measured by a laser diffraction/scattering particle diameter distribution measurement instrument with butyl carbitol acetate as a dispersion medium and the second particle diameter is a volume-based median diameter measured by the laser diffraction/scattering particle diameter distribution measurement instrument with isopropyl alcohol as a dispersion medium, this silver powder is suitable as a conductive filler for a conductive paste enabling low-temperature firing.

Note that upon GC-MS analysis of organic material at the surfaces of fine silver particles in the silver powders of the examples and comparative examples, a silver powder according to the present embodiment (silver powders of Examples 1 to 4) was found to have BTA attached and also to have linoleic acid attached as a fatty acid in Examples 1 and 2 and linolenic acid attached as a fatty acid in Examples 3 and 4. Although the attached amount of fatty acid was not quantified, the majority of an amount obtained by subtracting the residual amount of BTA from the ignition loss can be regarded as the attached amount of fatty acid in the silver powders of Examples 1 to 4 since the residual amount of BTA was small (0.03 wt % to 0.09 wt %) relative to the additive amount of BTA. A fatty acid is thought to be attached in an amount of 0.5 wt % to 0.7 wt % relative to silver in the present examples and comparative examples.

In this manner, the silver powder according to the present embodiment has an azole and linoleic acid or linolenic acid attached at a particle surface and thus includes an azole and linoleic acid or linolenic acid at a particle surface. This is thought to result in the silver powder according to the present embodiment having good compatibility with BCA and good dispersibility in BCA.

Note that qualitative analysis by a GC-MS of organic material at the surfaces of fine silver particles was performed by the following procedure. First, the silver powder was heated to 300° C. using a pyrolyzer (EGA/Py-3030D produced by Frontier Laboratories Ltd.). Organic material that detached from the surfaces of the fine silver particles was then analyzed using a GC-MS (7890A/5975C produced by Agilent Technologies).

As set forth above, it is possible to provide a silver powder that is suitable as a conductive filler for a conductive paste that enables low-temperature firing and a method of producing this silver powder. Note that configurations disclosed in the above-described embodiments can be adopted in combination with configurations disclosed in other embodiments so long as they are not in contradiction. Also note that the embodiments disclosed in the present specification are examples and that embodiments of the present disclosure are not limited thereto and can be modified as appropriate to the extent that they do not deviate from the object of the present disclosure.

INDUSTRIAL APPLICABILITY

The present disclosure is applicable for a silver powder and a method of producing the same.

The invention claimed is:

1. A silver powder having:

a specific surface area based on the BET method of not less than 1.5 $m^2/g$ and not more than 2.0 $m^2/g$;

a negative value for a difference determined by subtracting a second particle diameter from a first particle diameter given that the first particle diameter is a volume-based median diameter measured by a laser diffraction/scattering particle diameter distribution measurement instrument with butyl carbitol acetate as a dispersion medium and the second particle diameter is a volume-based median diameter measured by the laser diffraction/scattering particle diameter distribution measurement instrument with isopropyl alcohol as a dispersion medium; and an azole and an unsaturated fatty acid including two or more double bonds at a particle surface.

2. The silver powder according to claim 1, comprising an azole and linoleic acid at a particle surface.

3. The silver powder according to claim 1, comprising an azole and linolenic acid at a particle surface.

4. A silver powder having:

a specific surface area based on the BET method of not less than 2.5 $m^2/g$ and not more than 3.0 $m^2/g$;

a value of less than 0.3 μm for a difference determined by subtracting a second particle diameter from a first particle diameter given that the first particle diameter is a volume-based median diameter measured by a laser diffraction/scattering particle diameter distribution measurement instrument with butyl carbitol acetate as a dispersion medium and the second particle diameter is a volume-based median diameter measured by the laser diffraction/scattering particle diameter distribution measurement instrument with isopropyl alcohol as a dispersion medium; and an azole and an unsaturated fatty acid including two or more double bonds at a particle surface.

5. The silver powder according to claim 4, comprising an azole and linoleic acid at a particle surface.

6. The silver powder according to claim 4, comprising an azole and linolenic acid at a particle surface.

* * * * *